US005720632A

United States Patent [19]

Viklund

[11] Patent Number: 5,720,632

[45] Date of Patent: Feb. 24, 1998

[54] WIRE MANAGER CLIP

[75] Inventor: Mark Viklund, New Milford, Conn.

[73] Assignee: The Siemon Company, Watertown, Conn.

[21] Appl. No.: 652,753

[22] Filed: May 23, 1996

[51] Int. Cl.[6] ..... H01R 9/22

[52] U.S. Cl. ..... 439/719; 361/826

[58] Field of Search ..... 439/719, 532; 361/826; 174/72 A

[56] References Cited

U.S. PATENT DOCUMENTS 5,255,161 10/1993 Knoll et al. ..... 361/826

OTHER PUBLICATIONS

P. 1–39 of Anixter Bros., Inc. AT&T Systimax Premises Distribution System catalog (1992).

*Primary Examiner*—Kheim Nguyen
*Assistant Examiner*—Yong Ki Kim
*Attorney, Agent, or Firm*—Fishman, Dionne, Cantor & Colburn

[57] ABSTRACT

A wire manager for use with a wiring block assembly. The wire manager has a base portion connected to a retaining portion which together provide an area for wire management. The base portion includes a latching portion which has a lip for affixing the wire manager to the wiring block assembly. The wire manager is preferably made from plastic and is easily mounted to and removed from the wiring block assembly by compressing the base portion.

9 Claims, 5 Drawing Sheets

WIRE MANAGER CLIP

BACKGROUND OF THE INVENTION

1. Field of the Invention

The invention relates generally to a wire manager and in particular to a wire manager that is easily attachable and detachable from a wiring block assembly.

2. Prior Art

Wiring block assemblies of the type described herein are well known and are commercially available from AT&T Technologies. U.S. Pat. No. 5,312,270, which is incorporated herein by reference, describes conventional wiring block assemblies commonly referred to as the 110 type wiring system. The prior art includes a retainer clip for wire management, available from AT&T Technologies, which attaches to one leg of a 110 type wiring block assembly. The AT&T retainer clip is limited by its size, allowing only limited space for wire management along the legs of a 110 type wiring block assembly. In addition, this retainer clip attaches to only one leg of the wiring block assembly and thus multiple clips are needed to provide wire management at the end of the wiring block assembly. These limitations make wire management much more difficult and time consuming due to the fact that more retainer clips are required for a clean and organized installation and that removal of wires at a later time requires the wires to be removed from more retainers. The AT&T retainer clip also does not offer a means for easily removing the retainer clip from the legs after the retainer clip has been installed.

SUMMARY OF THE INVENTION

The above-discussed and other drawbacks and deficiencies of the prior art are overcome or alleviated by the wire manager of the invention. The wire manager of the present invention comprises a pair of base legs connected to a pair of retaining members. A latching portion is connected to each of the base legs for connecting the wire manager to a wiring assembly block. The wire manager is preferably made from an elastic material such as plastic and is connected to a wiring block assembly by compressing the two base legs, inserting the latching portion between two legs of the wiring block assembly and pushing the wire manager towards the wiring block assembly.

DETAILED DESCRIPTION OF THE INVENTION

Figure 1:
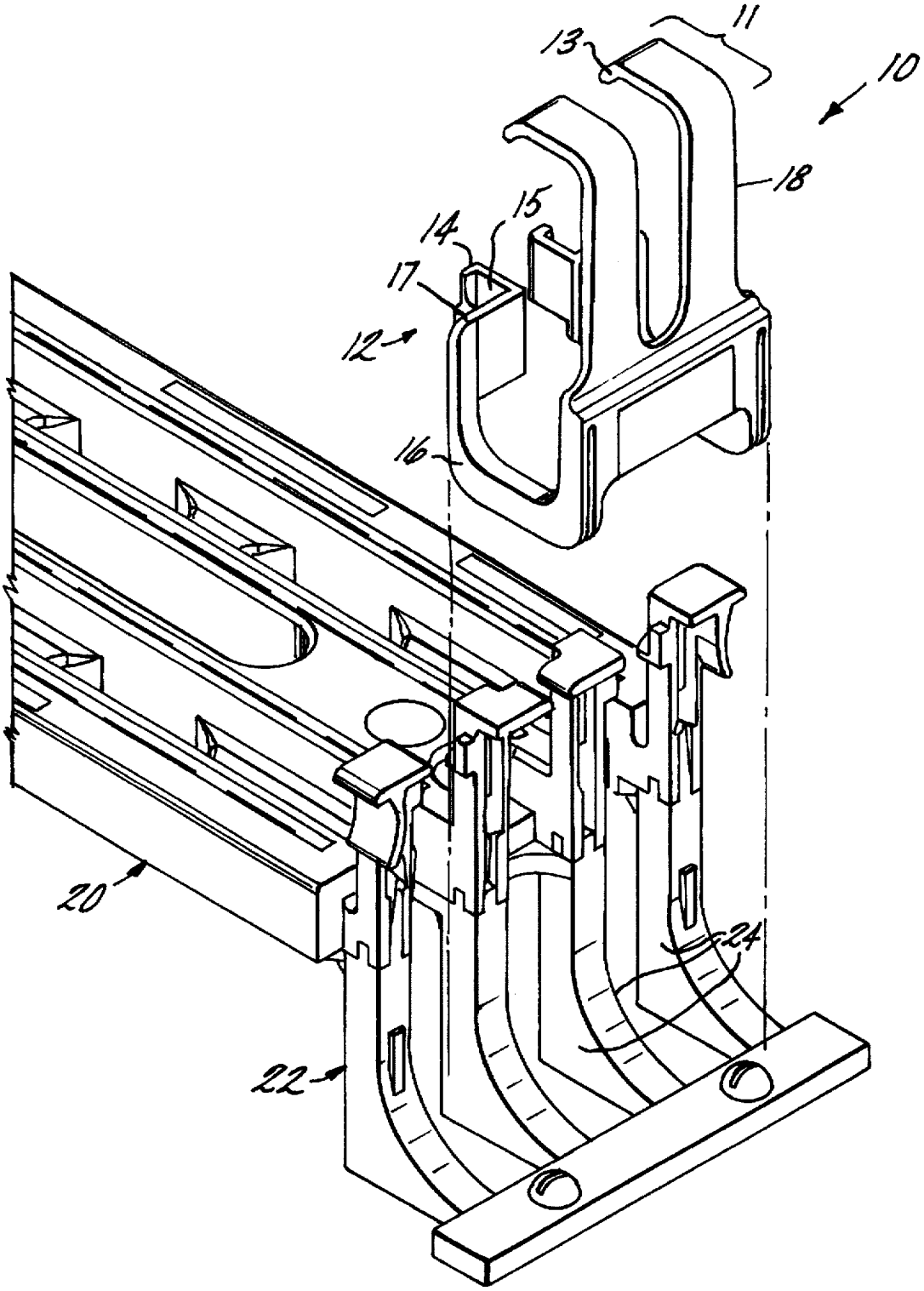
FIG. 1 is a perspective view of the wire manager of the present invention and a portion of a conventional wiring block assembly.

FIG. 1 is a perspective view of a wire manager which is shown generally at 10 and a wiring block assembly shown generally at 20. The wiring block assembly 20 is a conventional device and may be, for example, a series 110 wiring block assembly commercially available from The Siemon Company of Watertown, Conn. The wiring block assembly 20 includes legs 22, each of which has at least one interior surface 24. The wire manager 10 includes base legs 16 and retaining members 18 which, when the wire manager 10 is mounted to the wiring block assembly 20, form an area for wire management. Each retaining member 18 includes an extension 11 having a bevel 13. The extension 11 forms one side of the wire management area. The bevel 13 makes it easier to insert wires into the wire manager 10. Each base leg 16 includes a latching portion 12. The latching portion 12 includes a lip 14, a rib 17 and a latching portion surface 15. The lip 14 is substantially perpendicular to the latching portion surface 15. The rib 17 is substantially parallel to the latching portion surface 15. The wire manager 10 is mounted to the wiring block assembly 20 by placing the two latching portions 12 between any two legs of the wiring block assembly 20.

Figure 2:
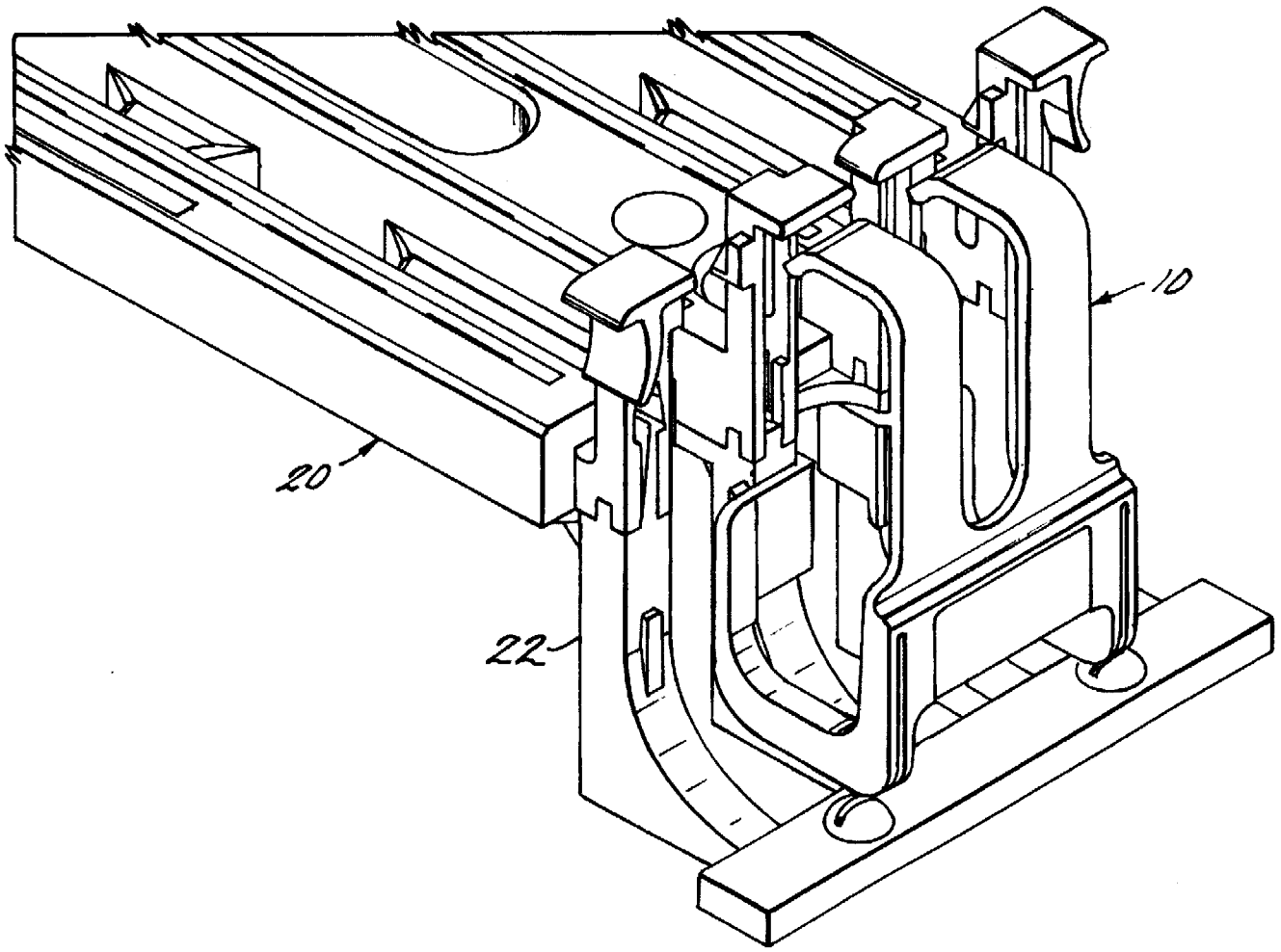
FIG. 2 is a perspective view of the wire manager of the present invention connected to the conventional wiring block assembly.
Figure 4:
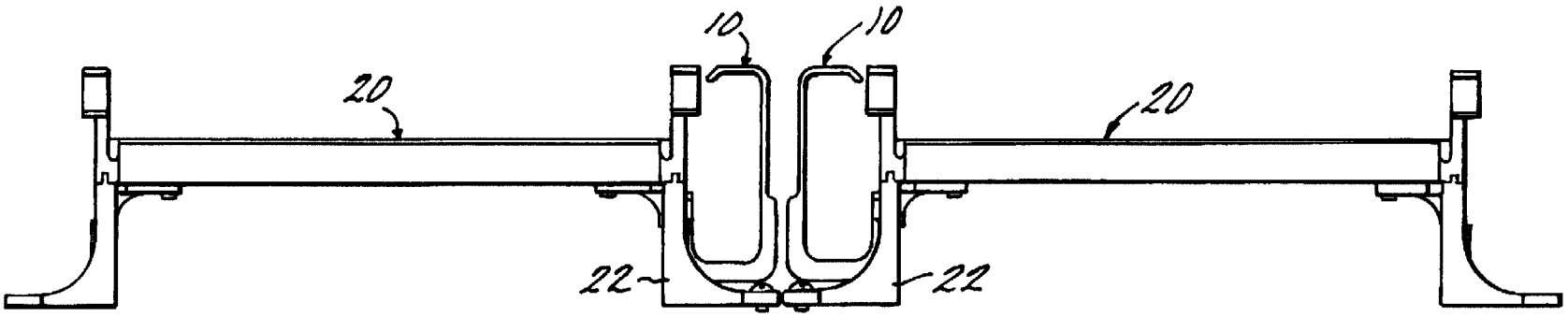
FIG. 4 is a side plan view of side-by-side wiring block assemblies, each including the wire manager of the present invention.

FIG. 2 illustrates the wire manager 10 mounted to the wiring block assembly 20. The latching portions 12 are placed between two adjacent legs 22 of the wiring block assembly 20. The wire manager 10 is mounted to the wiring block assembly 20 by placing the latching portions 12 between two legs 22. The wire manager 10 is then pushed toward the legs 22 and the latching portions 12 snap around the legs 22 connecting the wire manager 10 to the legs 22. Each latching portion surface 15 is positioned against an inner surface 24 of legs 22. The lip 14 is positioned against the surface of the leg 22 opposite the wire manager 10. The rib 17 is positioned adjacent to the surface of the leg opposite the latching portion surface 15. The interference fit between the latching portions 12 and the legs 22 prevents the wire manager 10 from becoming detached from the wiring block assembly 20. The wire manager 10 may be installed from the side or top of the wiring block assembly 20. Because the wire manager 10 can be installed from the side or top, it allows the use of adjacent wire managers when wiring block assemblies are mounted in a side-by-side arrangement as shown in FIG. 4. The wire manager 10 can also easily be removed from the wiring block legs 22 by pressing the outside of the base legs 16 and pulling the wire manager 10 away from the wiring block assembly 20. An advantage of the wire manager 10 is that only one wire manager 10 is required to provide proper wire management along the entire side of a wiring block assembly 20 whereas multiple retainer clips were required in the prior art. The wire manager 10 does not interfere with cables that enter from beneath the wiring block assembly 20.

The wire manager 10 is preferably manufactured from a resilient plastic (other materials being applicable albeit less convenient) so that cables can easily be inserted and removed from the wire manager 10. When the wire manager is attached to the wiring block legs 22, the base legs 16 flex to fit the latching portions 12 between the wiring block legs 22 and then return to their original state to grip onto the wiring block legs 22. Upon insertion of wires, the retaining members 18 will flex, allowing the wire to enter the wire management area formed by the retaining members 18 and the base legs 16. Once the wires are inserted, the retaining members 18 will return to their original state, holding the wires within the wire manager 10.

Figure 3:
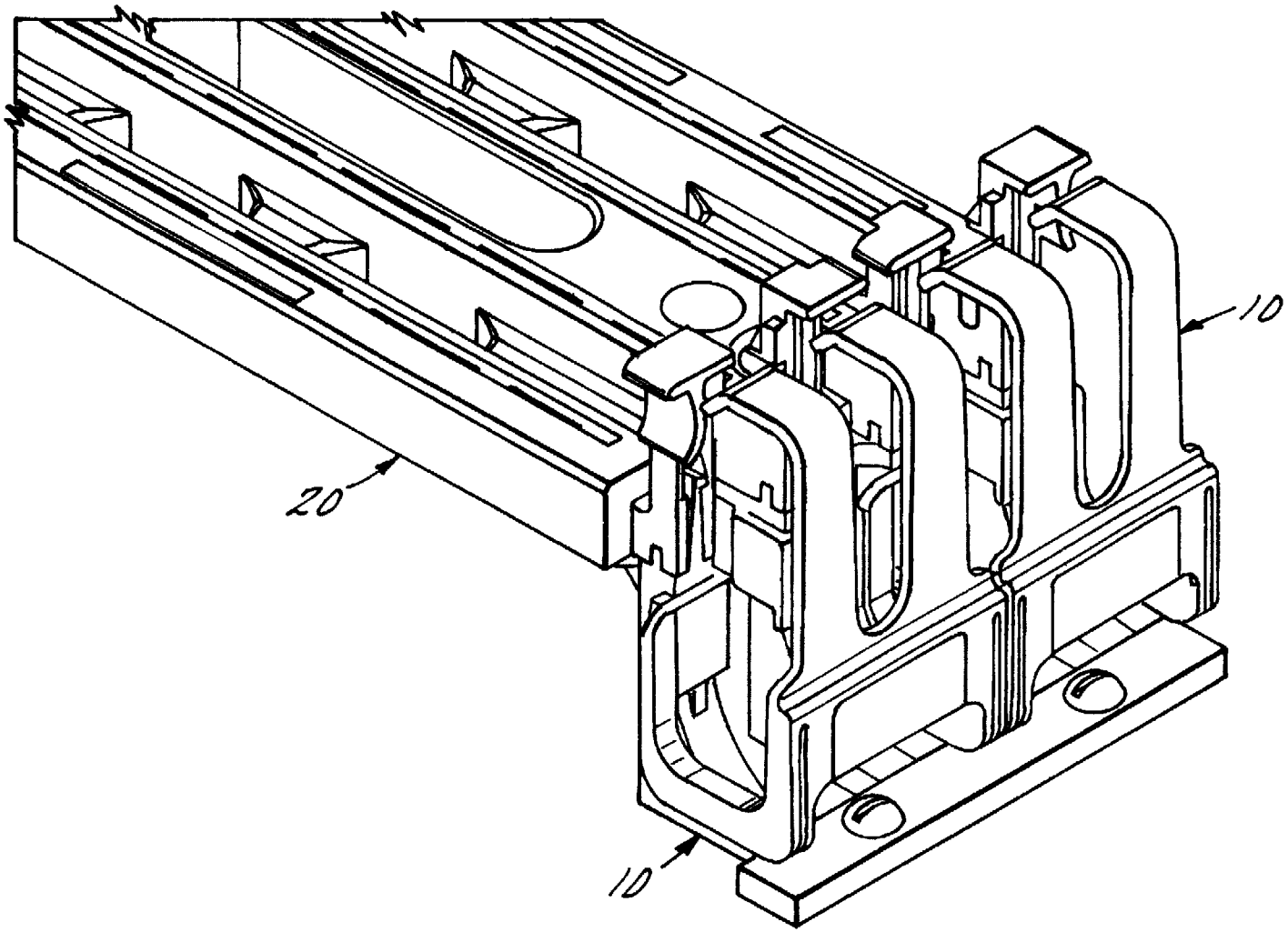
FIG. 3 is a perspective view of multiple wire managers connected to the conventional wiring block assembly.

FIG. 3 illustrates two wire managers 10 mounted to a wiring block assembly 20. The wire managers 10 are mounted to the wiring block assembly 20 in the same manner as described above with reference to FIG. 2. By using two wire managers 10, a larger wire management area is created.

FIG. 4 is a side view of two wiring block assemblies 20 positioned side-by-side. A wire manager 10 is mounted to each wiring block assembly 20. This arrangement provides for close placement of the wiring block assemblies 20 while still providing effective wire management through wire managers 10.

Figure 5G:
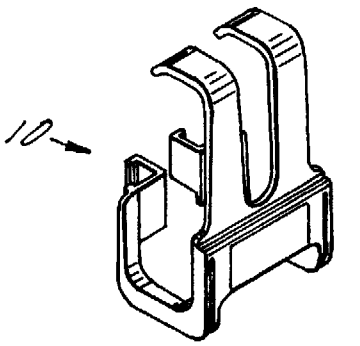
FIGS. 5F and 5G are perspective views of the wire manager of the present invention.
Figure 5F:
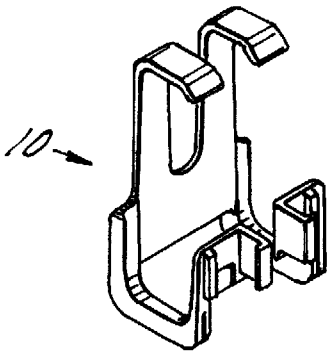
Figure 5B:
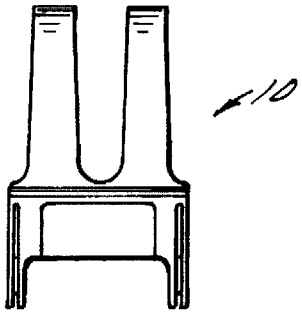
FIGS. 5A–5E are plan views of the wire manager of the present invention.
Figure 5E:
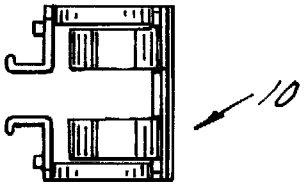
Figure 5A:
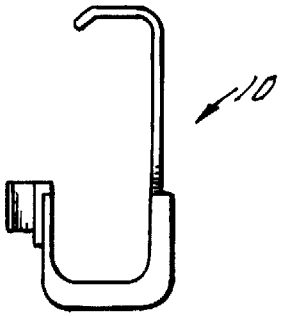
Figure 5C:
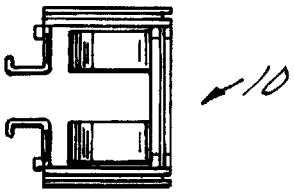
Figure 5D:
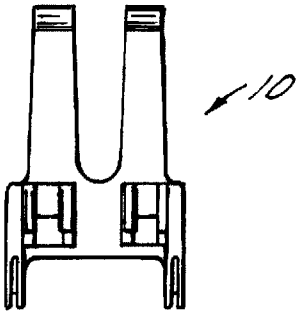

FIGS. 5A–5E are various plan views of the wire manager 10 of the present invention. FIGS. 5F and 5G are perspective views of the wire manager 10. The wire manager of the present invention provides numerous advantages over conventional wire retaining devices. The present invention provides the ability to overcome the space constraints that forced prior art designs to be limited in the cable management space that they offer. In addition, the latching portion that is released by compressing the two base legs of the wire manager allows the wire manager to be easily mounted to and removed from a wiring block assembly. Conventional wire retaining devices have no such means for easily removing a wire retainer after installation. By placing multiple wire managers along the legs of adjacent wiring block assemblies, the wire managers create a neat, clean and organized installation of wires while also allowing easy removal of any of the wires at a later time.

Although the wire manager 10 has been shown with a generally rectangular wire management area, alternate embodiments may include a wire manager with a different geometrical shape (square, round, oval, rectangular, triangular, etc.). The length and width of the wire manager 10 may also change and still achieve the same function. Thus, such modifications are within the scope of the invention.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A wire manager comprising:

a base portion including a pair of base legs;

a retaining portion connected to said base portion; and a latching portion connected to said base portion for connecting the wire manager to a wiring block assembly.

2. A wire manager comprising:

a base portion;

a retaining portion connected to said base portion including a pair of retaining members; and a latching portion connected to said base portion for connecting the wire manager to a wiring block assembly.

3. The wire manager of claim 1, wherein said latching portion comprises two latching portions, each of said base legs including one of said latching portions.

4. The wire manager of claim 3, wherein each of said latching portions includes a lip.

5. A wire manager comprising:

a base portion;

a retaining portion connected to said base portion; and a latching portion connected to said base portion for connecting the wire manager to a wiring block assembly;

wherein said latching portion engages at least one leg of the wiring block assembly.

6. The wire manager of claim 5, wherein said latching portion includes a lip.

7. The wire manager of claim 5, wherein said base portion, said retaining portion and said latching portion are made of plastic.

8. A wire manager comprising:

a base portion;

a retaining portion connected to said base portion; and a latching portion connected to said base portion for connecting the wire manager to a wiring block assembly;

wherein the wire manager is coupled to the wiring block assembly by applying force to said base portion, placing said latching portion between two legs of the wiring block assembly and pushing said base portion toward the wiring block assembly.

9. A wire manager for providing a wire management area for a wiring block assembly, the wire manager comprising:

a first base leg and a second base leg;

a first retaining member and a second retaining member connected to said first base leg and second base leg; and a first latching portion connected to said first base leg and a second latching portion connected to said second base leg, said first and second latching portions including a latching portion surface for contacting a surface of a leg of the wiring block assembly, said first and second latching portion having a lip extending perpendicular to said latching portion surface.

* * * * *

UNITED STATES PATENT AND TRADEMARK OFFICE

CERTIFICATE OF CORRECTION

PATENT NO. : 5,720,632

DATED : February 24, 1998

INVENTOR(S) : Mark Viklund

It is certified that error appears in the above-identified patent and that said Letters Patent is hereby corrected as shown below:

Column 1, line 49, delete " . " and insert therefor --;--.
Column 1, line 52, delete " . " and insert therefor --;--.
Column 1, line 54, delete " . " and insert therefor --;--.
Column 1, line 58, delete " . " and insert therefor --;--.
Column 1, line 60, delete " . " and insert therefor --;--.

Signed and Sealed this

Twenty-eighth Day of March, 2000

*Attest:*

*Attesting Officer*

Q. TODD DICKINSON

*Commissioner of Patents and Trademarks*